US009708097B2

(12) United States Patent
Banik

(10) Patent No.: US 9,708,097 B2
(45) Date of Patent: Jul. 18, 2017

(54) BULK BIN WITH INTEGRATED SHOCK ABSORBER

(71) Applicant: ORBIS Corporation, Oconomowoc, WI (US)

(72) Inventor: Joachim Banik, Oconomowoc, WI (US)

(73) Assignee: Orbis Corporation, Oconomowoc, WI (US)

( * ) Notice: Subject to any disclaimer, the term of this patent is extended or adjusted under 35 U.S.C. 154(b) by 0 days.

(21) Appl. No.: 14/541,267

(22) Filed: Nov. 14, 2014

(65) Prior Publication Data

US 2015/0136765 A1 May 21, 2015

Related U.S. Application Data

(60) Provisional application No. 61/904,836, filed on Nov. 15, 2013.

(51) Int. Cl.

| | |
|---|---|
| ***B65D 21/00*** | (2006.01) |
| ***B65D 6/34*** | (2006.01) |
| ***B65D 6/18*** | (2006.01) |
| ***B65D 21/02*** | (2006.01) |

(52) U.S. Cl.
CPC ..... *B65D 11/26* (2013.01); *B65D 11/1833* (2013.01); *B65D 21/0212* (2013.01)

(58) Field of Classification Search
CPC ..... A47B 47/0016; A45C 13/36
USPC ..... 206/511, 586, 599
See application file for complete search history.

(56) References Cited

U.S. PATENT DOCUMENTS

| | | | |
|---|---|---|---|
| 489,711 | A | 1/1893 | Mandioni |
| 1,039,452 | A | 9/1912 | Shepard |
| 1,280,629 | A | 10/1918 | Appleby |
| 1,381,013 | A | 6/1921 | Rainsford |
| 1,883,553 | A | 10/1932 | Chain |
| 2,579,655 | A | 12/1951 | Donald |
| 3,246,828 | A | 4/1966 | Branscum et al. |
| 3,572,535 | A | 3/1971 | Kinzie |
| 3,628,683 | A | 12/1971 | Friedrich et al. |
| 3,692,342 | A | 9/1972 | Scallan |
| 3,747,794 | A | 7/1973 | Bitney |

(Continued)

FOREIGN PATENT DOCUMENTS

| | | | |
|---|---|---|---|
| CA | 1319118 | A1 | 6/1993 |
| CA | 2665281 | A1 | 11/2009 |

(Continued)

OTHER PUBLICATIONS

International Search Report for PCT/US08/73306 mailed Nov. 24, 2008 (2 pages).

(Continued)

*Primary Examiner* — Shawn M Braden
(74) *Attorney, Agent, or Firm* — Nixon Peabody LLP

(57) ABSTRACT

A stackable bulk bin container having shock absorbing elements is provided. The bulk bin container includes a base portion and four collapsible sidewalls. The base includes feet extending downward. The feet are connected by stringers forming four corner portions. Shock absorbing elements are positioned proximate the corner portions in the base of the container. The shock absorbing elements absorb energy from impacts when the container is stacked on like containers.

19 Claims, 3 Drawing Sheets

(56) References Cited

U.S. PATENT DOCUMENTS 3,870,185 A 3/1975 Sanders et al.
3,874,546 A 4/1975 Sanders et al.
3,924,293 A 12/1975 Cain
3,977,044 A 8/1976 Mort
4,044,910 A 8/1977 Box
4,063,330 A 12/1977 Triplette
4,089,417 A 5/1978 Osborne
4,119,263 A 10/1978 Cuthbertson et al.
4,186,841 A 2/1980 Buckley et al.
4,192,430 A 3/1980 Cornou
4,300,695 A 11/1981 Hsu
4,349,121 A 9/1982 Lafferty
4,454,946 A 6/1984 Yokowo
4,466,541 A 8/1984 Tabler et al.
4,491,231 A 1/1985 Heggeland et al.
4,571,774 A 2/1986 Hinson
4,591,065 A 5/1986 Foy
4,674,647 A 6/1987 Gyenge et al.
4,765,480 A 8/1988 Malmanger
4,775,068 A 10/1988 Reiland et al.
4,798,304 A 1/1989 Rader
4,828,132 A 5/1989 Francis, Jr. et al.
4,863,062 A 9/1989 Holliday
4,917,255 A 4/1990 Foy et al.
4,923,079 A 5/1990 Foy
4,960,223 A 10/1990 Chiang et al.
4,967,927 A 11/1990 Reiland et al.
4,987,639 A 1/1991 Baiuley et al.
5,094,356 A 3/1992 Miller
5,114,037 A 5/1992 Hillis et al.
5,150,806 A 9/1992 Glomski
5,199,592 A 4/1993 Reiland et al.
5,289,935 A 3/1994 Hillis et al.
5,398,835 A 3/1995 Blinstrub
5,467,885 A 11/1995 Blinstrub
5,474,197 A 12/1995 Hillis et al.
5,501,353 A 3/1996 Warren
5,535,482 A 7/1996 Grabber
5,538,178 A 7/1996 Zink et al.
5,586,675 A 12/1996 Borsboom et al.
5,632,392 A 5/1997 Oh
D381,513 S 7/1997 Brauner
5,660,291 A 8/1997 Dash
5,673,791 A 10/1997 Jamison
5,711,444 A 1/1998 Meacham et al.
5,725,119 A 3/1998 Bradford et al.
5,769,230 A 6/1998 Koefelda
5,788,103 A 8/1998 Wagner et al.
5,797,508 A 8/1998 Loftus et al.
5,845,799 A 12/1998 Deaton
5,850,935 A 12/1998 Luburic et al.
5,897,012 A 4/1999 Sortwell
5,908,135 A 6/1999 Bradford et al.
5,938,059 A 8/1999 Luburic
5,975,324 A 11/1999 Schmitt
6,000,604 A 12/1999 Lapoint, III
6,015,056 A 1/2000 Overholt et al.
6,029,839 A 2/2000 Mansouri
6,029,840 A 2/2000 Brauner
6,062,410 A 5/2000 Bradford et al.
6,088,239 A 7/2000 Zeiss
6,135,287 A 10/2000 Hartwall
6,138,851 A 10/2000 Townson
6,186,932 B1 2/2001 Vallot
6,189,695 B1 2/2001 Ching-rong
6,209,742 B1 4/2001 Overholt et al.
6,216,872 B1 4/2001 Haasbroek
6,216,899 B1 4/2001 Vicari
6,223,903 B1 5/2001 Mansouri
6,230,916 B1 5/2001 Bradford et al.
6,234,315 B1 5/2001 Karpisek
6,243,920 B1 6/2001 Sauve
6,283,319 B1 9/2001 Hillis et al.
6,290,081 B1 9/2001 Merey
6,293,417 B1 9/2001 Varfeldt
6,293,418 B1 9/2001 Ogden et al.
6,305,566 B1 10/2001 Pigott et al.
6,305,726 B1 10/2001 LeTrudet
D452,614 S 1/2002 Overholt
6,367,630 B1 4/2002 Elskamp
6,386,388 B1 5/2002 Overholt
6,398,054 B1 6/2002 Overholt et al.
6,405,888 B1 6/2002 Overholt et al.
6,415,938 B1 7/2002 Karpisek
6,416,271 B1 7/2002 Pigott et al.
6,422,409 B2 7/2002 Kofod
6,446,825 B1 9/2002 Godoy
6,460,717 B1 10/2002 Smyers et al.
6,484,898 B2 11/2002 Hillis et al.
RE37,915 E 12/2002 Lapoint, III
6,540,096 B1 4/2003 Bazany et al.
6,543,659 B2 4/2003 Blair
6,601,724 B1 8/2003 Koefelda et al.
6,631,822 B1 10/2003 Overholt
6,669,044 B2 12/2003 Murakami et al.
6,691,885 B2 2/2004 Brown
6,726,046 B2 4/2004 Orset
6,776,300 B2 * 8/2004 Walsh ..... B65D 19/18 206/386
6,783,032 B2 8/2004 Fons
6,783,058 B2 8/2004 Quaintance
6,786,394 B2 9/2004 Prince
6,805,254 B2 10/2004 Tanzer et al.
6,820,761 B1 11/2004 Mouri et al.
6,838,616 B2 1/2005 Harrison et al.
6,863,180 B2 3/2005 Apps et al.
6,868,979 B2 3/2005 Rader
6,877,628 B2 4/2005 Nesting
6,899,242 B2 5/2005 Overholt et al.
6,902,061 B1 6/2005 Elstone
6,918,502 B1 7/2005 Overholt et al.
6,955,273 B2 10/2005 Hartwall
6,966,449 B2 11/2005 Williams
7,011,225 B2 3/2006 Oster et al.
7,017,765 B2 3/2006 Overholt
7,017,766 B2 3/2006 Hsu et al.
7,032,765 B2 4/2006 Miller et al.
7,044,319 B2 5/2006 Overholt et al.
7,048,135 B2 5/2006 Smyers et al.
7,059,489 B2 6/2006 Apps et al.
7,063,223 B2 6/2006 Iwahara et al.
7,083,369 B2 8/2006 Nyeboer
7,100,786 B2 9/2006 Smyers
7,104,414 B2 9/2006 Apps et al.
7,128,209 B2 10/2006 Bringard et al.
7,128,231 B2 10/2006 Overholt
7,137,522 B2 11/2006 Dubois
7,156,249 B2 1/2007 Heinrichs
7,159,730 B2 1/2007 Rumpel
7,195,127 B2 3/2007 Hsu et al.
7,258,232 B2 8/2007 Bradford et al.
7,264,122 B2 9/2007 Koefelda et al.
7,287,661 B2 10/2007 Knutsson et al.
7,311,220 B2 12/2007 Kellerer
7,331,480 B1 2/2008 Nolan
7,347,328 B2 3/2008 Hartwall
7,357,269 B2 4/2008 Apps
7,357,271 B2 4/2008 Hase et al.
7,370,771 B2 5/2008 Rader
7,416,092 B2 8/2008 Dubois et al.
7,438,197 B2 10/2008 Yamauchi
7,478,734 B2 1/2009 Vargas
7,484,634 B2 2/2009 Apps
7,540,390 B2 6/2009 Bublitz et al.
7,549,550 B2 6/2009 Smyers et al.
7,556,165 B2 7/2009 McDade
7,556,166 B2 * 7/2009 Parnall ..... B65D 11/1833 220/4.28
7,708,160 B2 5/2010 Booth et al.
7,748,330 B2 7/2010 Dubois et al.
7,774,919 B2 8/2010 Bublitz et al.
7,828,167 B2 11/2010 Nolan
7,841,487 B2 11/2010 Miller et al.
7,861,458 B2 1/2011 Apps et al.

(56) References Cited

U.S. PATENT DOCUMENTS

| | | | |
|---|---|---|---|
| 7,861,879 | B2 | 1/2011 | Samprathi |
| 8,109,402 | B2 | 2/2012 | Hartwall |
| 8,181,806 | B2 | 5/2012 | Hidalgo Vargas |
| 8,210,379 | B2 | 7/2012 | Afflerbach et al. |
| 8,267,270 | B2 | 9/2012 | Samprathi |
| 8,308,015 | B2 | 11/2012 | Bradford |
| 8,413,831 | B2 | 4/2013 | Nolan |
| 8,434,618 | B2 | 5/2013 | Mitchell et al. |
| 8,485,376 | B2 | 7/2013 | Samprathi |
| 8,511,496 | B2 | 8/2013 | Van Der Korput et al. |
| 8,727,158 | B2 | 5/2014 | Nolan |
| 8,727,165 | B2 | 5/2014 | Nolan |
| 8,820,558 | B2 | 9/2014 | Van der Korput et al. |
| 8,820,560 | B2 | 9/2014 | Nolan |
| 2002/0108950 | A1 | 8/2002 | Moorman et al. |
| 2004/0065699 | A1 | 4/2004 | Schoer et al. |
| 2004/0149610 | A1* | 8/2004 | Schutz ..... B65D 77/0466 206/386 |
| 2005/0103797 | A1 | 5/2005 | Rader et al. |
| 2006/0011627 | A1 | 1/2006 | Overholt et al. |
| 2007/0029319 | A1 | 2/2007 | Speck |
| 2007/0056967 | A1 | 3/2007 | Dobrinski et al. |
| 2007/0056977 | A1 | 3/2007 | Dobrinski et al. |
| 2007/0068941 | A1 | 3/2007 | Dubois |
| 2007/0075077 | A1 | 4/2007 | Dubois |
| 2007/0095842 | A1 | 5/2007 | Apps |
| 2007/0140684 | A1 | 6/2007 | Tsang |
| 2007/0181587 | A1 | 8/2007 | Burnham |
| 2007/0194023 | A1 | 8/2007 | Apps et al. |
| 2007/0272579 | A1 | 11/2007 | Cavalcante |
| 2007/0278223 | A1 | 12/2007 | Ficker |
| 2008/0017638 | A1 | 1/2008 | Bradford |
| 2008/0116199 | A1 | 5/2008 | Bublitz et al. |
| 2008/0116201 | A1 | 5/2008 | Baltz |
| 2008/0169285 | A1 | 7/2008 | Marazita et al. |
| 2010/0018966 | A1 | 1/2010 | Roberts, Sr. et al. |
| 2010/0038331 | A1 | 2/2010 | Ydstrom |
| 2010/0072199 | A1 | 3/2010 | Manuel |
| 2010/0239730 | A1 | 9/2010 | Ditter |
| 2010/0275426 | A1 | 11/2010 | Bublitz et al. |
| 2011/0127275 | A1 | 6/2011 | Dubois |
| 2011/0139775 | A1 | 6/2011 | Nolan |
| 2011/0210027 | A1* | 9/2011 | Decroix ..... B65D 19/40 206/386 |
| 2012/0152798 | A1 | 6/2012 | Allegretti et al. |
| 2012/0205369 | A1 | 8/2012 | Nolan |
| 2012/0261303 | A1* | 10/2012 | Schutz ..... B65D 77/0466 206/599 |
| 2012/0318692 | A1 | 12/2012 | Kellerer |
| 2013/0048522 | A1 | 2/2013 | Lorenz et al. |
| 2013/0221003 | A1 | 8/2013 | Carver et al. |
| 2014/0042175 | A1 | 2/2014 | Nolan |
| 2014/0117035 | A1 | 5/2014 | Petersen et al. |
| 2014/0252018 | A1 | 9/2014 | Nolan |

FOREIGN PATENT DOCUMENTS

| | | | |
|---|---|---|---|
| CN | 200930355382.X | | 7/2010 |
| CN | 200930355383.4 | | 7/2010 |
| CN | 200930355384.9 | | 7/2010 |
| CN | 201020111642.6 | | 11/2010 |
| CN | 201020145498.8 | | 12/2010 |
| CN | 201020159206.6 | | 12/2010 |
| CN | 201020198781.7 | | 12/2010 |
| CN | 201020132357.2 | | 1/2011 |
| CN | 201020218082.4 | | 1/2011 |
| CN | 201020218085.8 | | 4/2011 |
| CN | 201020169698.7 | | 5/2011 |
| DE | 135488 | C | 11/1933 |
| EP | 0385914 | A1 | 5/1990 |
| EP | 0485672 | A1 | 5/1992 |
| EP | 0785142 | A1 | 7/1997 |
| EP | 0768229 | B1 | 7/1999 |
| EP | 1019293 | B1 | 5/2002 |
| EP | 0737152 | B1 | 8/2002 |
| EP | 1350728 | A2 | 10/2003 |
| EP | 1418130 | A1 | 5/2004 |
| EP | 1427641 | B1 | 6/2004 |
| EP | 1461259 | B1 | 9/2004 |
| EP | 1652646 | A2 | 5/2006 |
| EP | 1440011 | B1 | 6/2006 |
| EP | 1472147 | B1 | 9/2006 |
| EP | 1827942 | A2 | 9/2007 |
| EP | 1927552 | A2 | 6/2008 |
| EP | 1935792 | A1 | 6/2008 |
| EP | 1616803 | B1 | 10/2009 |
| FR | 80400 | E | 10/1961 |
| FR | 2272907 | A1 | 12/1975 |
| GB | 2415689 | A | 1/2006 |
| GB | 2425303 | A | 10/2006 |
| GB | 2431921 | A | 5/2007 |
| GB | 2431922 | A | 5/2007 |
| GB | 2438506 | A | 11/2007 |
| GB | 2443949 | A | 5/2008 |
| GB | 2426237 | B | 12/2008 |
| JP | 03381677 | A | 12/2002 |
| KR | 1999-0061830 | | 7/1999 |
| SE | 323908 | B | 5/1970 |
| SE | 522095 | C2 | 1/2004 |
| WO | 0176960 | A1 | 10/2001 |
| WO | 03024815 | A1 | 3/2003 |
| WO | 03029090 | A1 | 4/2003 |
| WO | 03059763 | A1 | 7/2003 |
| WO | 03074376 | A1 | 9/2003 |
| WO | 03078259 | A1 | 9/2003 |
| WO | 03101846 | A1 | 12/2003 |
| WO | 2004033311 | A2 | 4/2004 |
| WO | 2004080830 | A1 | 9/2004 |
| WO | 2004085779 | A2 | 10/2004 |
| WO | 2004094250 | A1 | 11/2004 |
| WO | 2004101376 | A1 | 11/2004 |
| WO | 2005102852 | A1 | 11/2005 |
| WO | 2006044488 | A2 | 4/2006 |
| WO | 2006062894 | A2 | 6/2006 |
| WO | 2007035464 | A2 | 3/2007 |
| WO | 2007109468 | A2 | 9/2007 |
| WO | 2008033668 | A2 | 3/2008 |
| WO | 2009023830 | A1 | 2/2009 |

OTHER PUBLICATIONS

International Search Report for PCT/US2013/067243 mailed Feb. 7, 2014 (3 pages).

International Preliminary Report on Patentability and Written Opinion of International Searching Authority for PCT/US2008/073306 mailed Feb. 16, 2010 (6 pages).

Written Opinion of International Searching Authority for PCT/US2013/067243 mailed Feb. 7, 2014 (4 pages).

* cited by examiner

BULK BIN WITH INTEGRATED SHOCK ABSORBER

CROSS-REFERENCE TO RELATED APPLICATIONS

The present application claims the benefit of Provisional Application No. 61/904,836 filed Nov. 15, 2013, the contents of which are incorporated herein by reference.

FEDERALLY SPONSORED RESEARCH OR DEVELOPMENT

N/A

FIELD OF THE INVENTION

The present invention is generally directed toward bulk bin containers with shock absorbing elements that distribute forces from an impact to a stack of such containers; and more particularly, to bulk bin containers with bottom structures that include integrated shock absorbers to more evenly distribute horizontal forces impacting two or more stacked bins.

DESCRIPTION OF THE PRIOR ART

Plastic bulk bin containers typically consist of a base and four hingeably connected sidewalls. The sidewalls are in an approximately horizontal position when the bulk container is in a collapsed state, and in a vertical position when the container is erected to receive shipping goods. The sidewalls have features along each side that interlock with adjacent sidewalls when containers are erected. Most bulk bin containers are designed to stack on each other in the erected state, with and without the use of top caps.

To align containers in a stack and prevent them from sliding off each other when no top cap is used, the bottom section of a container base is typically recessed to fit in-between the sidewalls of an erected container. This recess is typically between ½" and 1" deep.

One weakness of this prior design becomes apparent when a stack of containers is subjected to impacts as typically occur in use. For example: a stack of loaded containers is moved via fork lift, and the stack is moved into an obstacle, such as a guide rail; stacks of loaded containers are moved by rail and encounter horizontal impacts as they occur in switching situations; and during stacking of loaded containers, the upper container is slightly angled and moved into position above the lower container until the recess on the bottom of the upper container hits the inside top edge of a sidewall in the lower container.

In all these instances, one of the sidewalls of the lower container is subjected to high horizontal forces at the top edge of the sidewall that try to push the wall outward, generated by movement of the upper container. These forces result in high stresses in the upper sections of the two adjacent corners of the sidewall of the lower container, which quite often result in breakage as shown in FIG. 3.

The present invention provides structure to distribute forces resulting from impacts to stacked bulk bins and reduces or prevents the amount of damage caused by such impacts. The present invention is described below and shown in the Figures.

SUMMARY OF THE INVENTION

The present invention is directed to a bulk bin container with collapsible sidewalls having integrated shock absorbing elements. The shock absorbing elements absorb impacts to a stack of containers to prevent or limit damage to the containers.

In accordance with a first embodiment, a collapsible bulk bin container with one or more shock absorbing elements is provided. The container includes a base having a rectangular bottom portion including a first side, a second side, a third side and a fourth side, a first base corner, a second base corner, a third base corner and a fourth base corner. A first sidewall extends upward from the first side of the base, a second sidewall extends upward from the second side of the base, a third sidewall extends upward from the third side of the base, and a fourth sidewall extends upward from the fourth side of the base. The first, second, third and fourth sidewalls form a rectangular opening at a top end of the container. A first sidewall corner is formed between the first sidewall and the second sidewall, a second sidewall corner is formed between the second sidewall and the third sidewall, a third sidewall corner is formed between the second sidewall and the third sidewall and a fourth sidewall corner is formed between the fourth sidewall and the first sidewall. A first shock absorbing element is positioned at the first base corner for contacting an interior side of the first sidewall corner of another like container when stacked on the like container.

As used herein, a "like" container is another container that includes at least features that allow it to stack with the claimed container. The "like" container does not have to be identical to the present container. However, an identical container would also be considered a "like" container.

The bulk bin container further comprises a second shock absorbing element positioned at the second base corner, a third shock absorbing element positioned at the third base corner, and a fourth shock absorbing element positioned at the fourth base corner. Each of the second, third and fourth shock absorbing elements contact interior portions of the second, third and fourth sidewall corners respectively of the like container. The shock absorbing elements can be formed from an elastomeric material, or other suitable material(s).

The shock absorbing elements can be L-shaped and can include a rounded outer corner portion. The shock absorbing element can be a continuous piece, or can be formed by a plurality of segments with or without a gap between adjacent segments.

Additionally, the shock absorbing elements can include a plurality of holes or other structures to facilitate the absorption of energy during an impact. Moreover, the holes in the main material forming the element can be filled with another type of material.

The base can include a plurality of feet extending downward from a bottom portion of the base. Additionally, the base can include a plurality of stringers connected to the feet. The stringers can form the first base corner, the second base corner, the third base corner and the fourth base corner. The shock absorbing elements can be positioned proximate an outer portion of the corners formed by the stringers.

The base corner portion formed by the stringers can include an inset portion. The inset is used to accommodate wider shock absorbing elements.

In accordance with another embodiment of the present invention, a stackable bulk bin container having at least one shock absorbing element is provided. The container has a rectangular base having a first side, a second side, a third side and a fourth side. A first foot extends downward from a first corner of the base, a second foot extends downward from a second corner of the base, a third foot extends downward from a third corner of the base, and a fourth foot extends downward from a fourth corner of the base. A first sidewall extends upward from the first side of the base, a second sidewall extends upward from the second side of the base, a third sidewall extends upward from the third side of the base, and a fourth sidewall extends upward from the fourth side of the base. The first, second, third and fourth sidewalls form a rectangular opening at a top end of the container. A first shock absorbing element is connected to the first foot and is configured to contact an interior portion of another like container when stacked on the like container.

The container can further comprise a second shock absorbing element connected to the second foot, a third shock absorbing element connected to the third foot and a fourth shock absorbing element connected to the fourth foot. Each of the second, third and fourth shock absorbing elements are configured to contact an interior corner portion of the like container.

The sidewalls of the container can be collapsible. Additionally, a plurality of stringers can connect the first foot, second foot, third foot and fourth foot.

Further aspects of the invention are disclosed below and shown in the Figures.

BRIEF DESCRIPTION OF THE DRAWINGS

To understand the present invention, it will now be described by way of example, with reference to the accompanying drawings in which.

DETAILED DESCRIPTION

Figure 1:
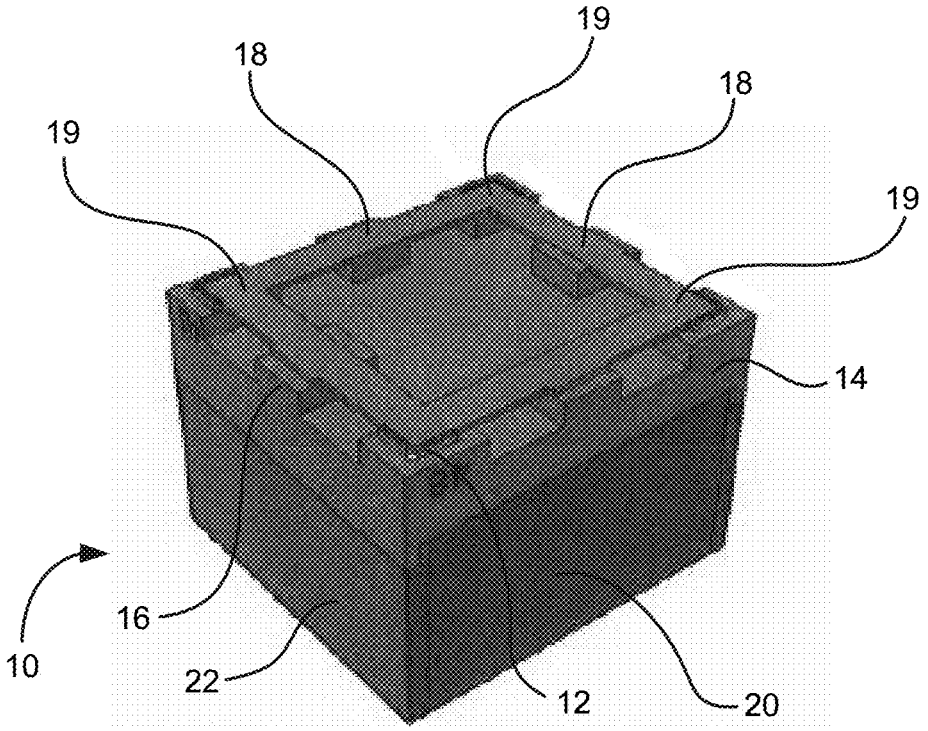
FIG. 1 is a perspective view of a bottom of a bulk bin container in accordance with the present invention.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

Figure 2:
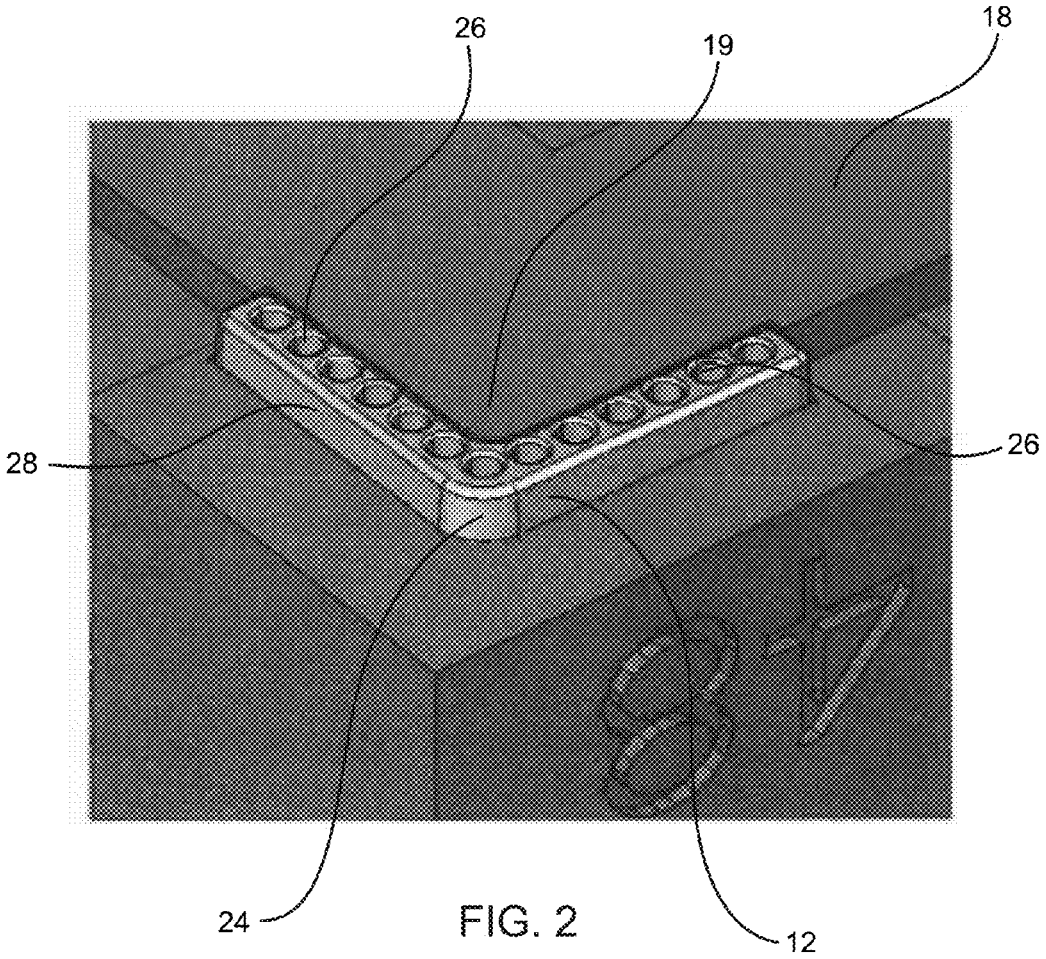
FIG. 2 is a partial, enlarged perspective view of a corner of the bulk bin container of FIG. 1.

FIGS. 1 and 2 show a bulk bin container 10 with a shock absorbing element 12 in accordance with the present invention. The bulk bin container 10 (shown upside down in both Figures) includes a rectangular base 14 having a first side, a second side, a third side and a fourth side and a plurality of feet 16 extending from the base along a periphery thereof. In the embodiment shown, the container 10 includes eight feet. More or fewer feet can be utilized depending on the size of the bulk bin at issue. A plurality of stringers 18 form a rectangular shape having four corners 19, and connect the feet 16.

The container 10 includes a first sidewall 20, a second sidewall 22, a third sidewall and a fourth sidewall extending from the first, second, third and fourth sides of the base 14, respectively. The sidewalls can be hingedly connected to the base 14 and can move from a collapsed position to an erected-set-up position. The sidewalls form a rectangular opening at the top of the container (when turned base side down).

The stringers 18 are shown inset from an outer periphery of the base, and are positioned to fit within the opening formed by the sidewalls of the bulk bin container 10.

As illustrated in FIGS. 1 and 2, each corner formed by the stringers 18 includes a shock absorbing element 12. The shock absorbing element 12 is generally L-shaped and includes a rounded outer corner portion 24.

The shock absorbing element 12 extends outward from the corner 19 of the stringers 18 to contact the corner of the opening formed by the sidewalls when the container 10 is set up. As shown in FIG. 2, the shock absorbing element 12 has a thickness that allows it to fit between the stringers 18 and the opening of the container 10. If additional thickness is required or wanted, the stringers can be provided with an inset in the corner portion 19 to allow for a thicker shock absorbing element 12 while still maintaining the outer dimensions of the outer surface of the shock absorbing element 12.

During use the shock absorbing element will absorb some of the kinetic energy that is transferred on impact from the upper container to the lower container (of two stacked containers). This reduces the amount of energy that can cause damage to the lower bin. The shock absorbing element also more evenly distributes the forces that occur during impact onto the corners of the lower container.

Figure 3:
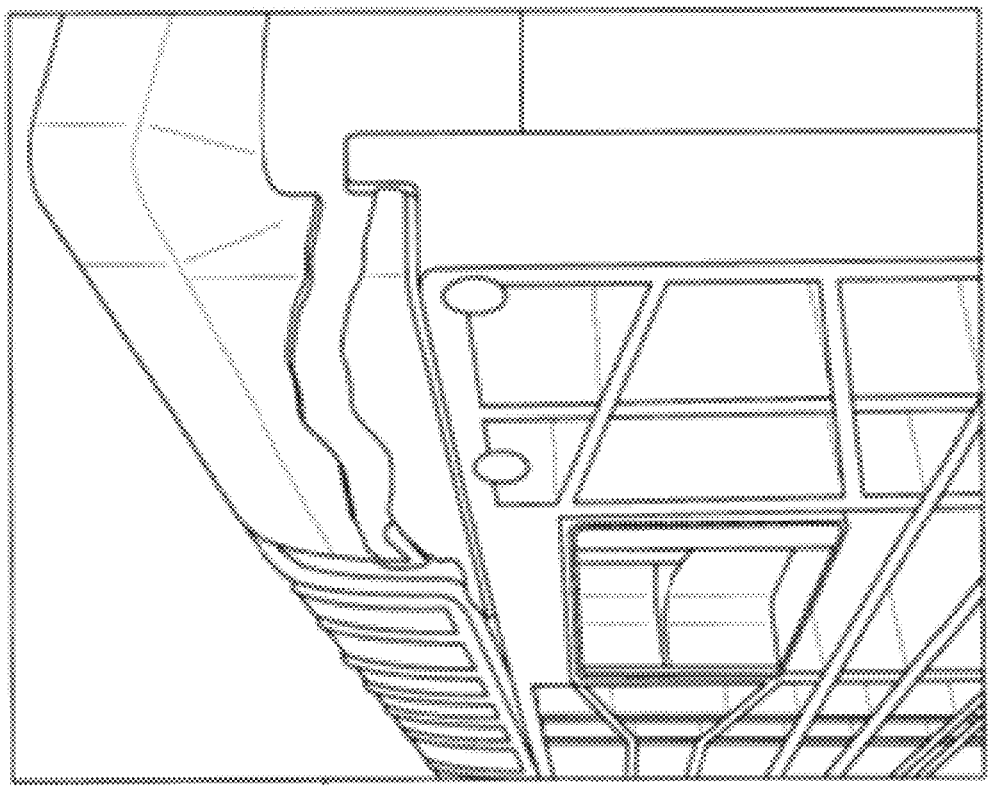
FIG. 3 is a partial perspective view of a prior container with damage to the corner area.

An example of damage caused by impacts to a stack of containers is shown in FIG. 3. The corner portion of the container is broken from an impact.

The shock absorbing element 12 can be formed from an elastomeric material or other suitable material for absorbing forces. Additionally, the shock absorbing element can be formed from more than one material, and can include additional structures to enhance the absorption of energy from impacts or other movement of the containers.

As shown in FIG. 2, the shock absorbing element 12 can include a plurality of openings 26 that will give the shock absorbing element 12 a spring-like quality. The openings 26 can be cylindrical and hollow (as shown) or can be filled with a material—such as one with a different elastic quality than the rest of the element. Moreover, the openings can be shapes other than cylindrical.

While the shock absorbing element 12 is shown as a single continuous corner piece, it can be formed from two or more pieces or segments. Additionally, shock absorbing element 12 can have a continuous outer surface 28, or can include one or more gaps or indentations.

In one alternative embodiment, shock absorbing elements can be placed along the upper portion of the sidewalls, positioned to contact the corners 19 formed by the stringers 18 (or other corner structure for containers not having stringers). In another alternative embodiment, both the corner portion of the stringers and the upper portions of the sidewalls can include shock absorbing elements. Additionally, shock absorbing elements can be positioned along the stringers and/or the upper portions of the sidewalls at other positions (than just the corners).

Many modifications and variations of the present invention are possible in light of the above teachings. It is, therefore, to be understood within the scope of the appended claims the invention may be protected otherwise than as specifically described.

I claim:

1. A bulk bin container comprising:

a base having a rectangular bottom portion including a first side, a second side, a third side and a fourth side, a first base corner, a second base corner, a third base corner and a fourth base corner;

a first sidewall extending upward from the first side of the base;

a second sidewall extending upward from the second side of the base;

a third sidewall extending upward from the third side of the base;

a fourth sidewall extending upward from the fourth side of the base, the first, second, third and fourth sidewalls forming a rectangular opening at a top end of the container, a first sidewall corner formed between the first sidewall and the second sidewall, a second sidewall corner formed between the second sidewall and the third sidewall, a third sidewall corner formed between the third sidewall and the fourth sidewall and a fourth sidewall corner formed between the fourth sidewall and the first sidewall;

a first foot extending downward from the first base corner, a second foot extending downward from the second base corner, a third foot extending downward from the third base corner and a fourth foot extending downward from the fourth base corner, the first foot having a planar lower surface that extends from an outer perimeter of the container defined in part by an outer surface of the first sidewall and an outer surface of the second sidewall wherein at least a portion of the planar lower surface of the first foot is configured to rest on an upper edge of a first sidewall and a second sidewall of another like container when stacked on the another like container;

a plurality of stringers connecting the first foot, second foot, third foot and fourth foot; and, a first shock absorbing element extending downward from the planar lower surface of the first foot, the first shock absorbing element having an inner surface abutting an edge of a first corner portion of the plurality of stringers and extending outward to an outer surface, the first shock absorbing element spaced inwardly from an outer edge of the first foot for contacting an interior side of the first sidewall corner of the another like container with the outer surface when stacked on the like container.

2. The bulk bin container of claim 1 wherein the second foot having a planar lower surface that extends from an outer perimeter of the container defined in part by an outer surface of the second sidewall and an outer surface of the third sidewall and wherein at least a portion of the planar lower surface of the second foot is configured to rest on an upper edge of the second sidewall and a third sidewall of the another like container when stacked on the another like container, and wherein the third foot having a planar lower surface that extends from an outer perimeter of the container defined in part by an outer surface of the third sidewall and an outer surface of the fourth sidewall and wherein at least a portion of the planar lower surface of the third foot is configured to rest on an upper edge of the third sidewall and a fourth sidewall of the another like container when stacked on the another like container, the fourth foot having a planar lower surface that extends from an outer perimeter of the container defined in part by an outer surface of the fourth sidewall and an outer surface of the first sidewall and wherein at least a portion of the planar lower surface of the fourth foot is configured to rest on an upper edge of the first sidewall and the fourth sidewall of the another like container when stacked on the another like container; and, further comprising a second shock absorbing element extending downward from the planar lower surface of the second foot, the second shock absorbing element having an inner surface abutting an edge of a second corner portion of the plurality of stringers and extending outward to an outer surface, the second shock absorbing element spaced inwardly from an outer edge of the second foot; a third shock absorbing element extending downward from the planar lower surface of the third foot, the third shock absorbing element having an inner surface abutting an edge of a third corner portion of the plurality of stringers and extending outward to an outer surface, the third shock absorbing element spaced inwardly from an outer edge of the third foot; and a fourth shock absorbing element extending downward from the planar lower surface of the fourth foot, the fourth shock absorbing element having an inner surface abutting an edge of a fourth corner portion of the plurality of stringers and extending outward to an outer surface, the fourth shock absorbing element spaced inwardly from an outer edge of the fourth foot, wherein each of the outer surfaces of the second, third and fourth shock absorbing elements contact interior portions of the second, third and fourth sidewall corners respectively of the like container.

3. The bulk bin container of claim 1 wherein the first shock absorbing element is formed from an elastomeric material.

4. The bulk bin container of claim 1 wherein the first shock absorbing element is L-shaped.

5. The bulk bin container of claim 4 wherein the first shock absorbing element has a rounded outer corner portion.

6. The bulk bin container of claim 1 wherein the base includes a plurality of additional feet extending downward from a bottom portion of the base, each of the additional feet spaced from a corner of the base.

7. The bulk bin container of claim 6 wherein the plurality of stringers form a rectangular shape.

8. The bulk bin container of claim 1 wherein the first shock absorbing element extends downward to a position equal to the stringers.

9. The bulk bin container of claim 1 wherein the first shock absorbing element includes a plurality of holes.

10. The bulk bin container of claim 1 wherein the first shock absorbing element is formed from a plurality of shock absorbing segments.

11. A bulk bin container comprising:

a rectangular base having a first side, a second side, a third side and a fourth side, a first foot extending downward from a first corner of the base, a second foot extending downward from a second corner of the base, a third foot extending downward from a third corner of the base, and a fourth foot extending downward from a fourth corner of the base;

a first sidewall extending upward from the first side of the base;

a second sidewall extending upward from the second side of the base;

a third sidewall extending upward from the third side of the base;

a fourth sidewall extending from the fourth side of the base, wherein the first, second, third and fourth sidewalls form a rectangular opening at a top end of the container;

a plurality of stringers connected to and extending downward from the first foot, second foot, third foot and fourth foot; and, a first shock absorbing element connected to and extending downward from a lower surface of the first foot wherein the lower surface of the first foot extends from an outer edge aligned with an outer surface of the first sidewall and the second sidewall, the first shock absorbing element spaced inward from the outer edge of the lower surface of the first foot so that it can contact an interior portion of another like container when stacked on the like container, the first shock absorbing element having an inner surface contacting a first corner defined by the plurality of stringers and an outer surface for contacting the another like container wherein the first shock absorbing element extends outward from the first corner defined by the plurality of stringers.

12. The container of claim 11 wherein the sidewalls are collapsible.

13. The container of claim 11 wherein further comprising a second shock absorbing element connected to and extending downward from a lower surface of the second foot wherein the lower surface of the second foot extends from an outer edge aligned with an outer surface of the second sidewall and the third sidewall, the second shock absorbing element having an inner surface contacting a second corner defined by the plurality of stringers and an outer surface for contacting the another like container wherein the second shock absorbing element extends outward from the second corner defined by the plurality of stringers, a third shock absorbing element connected to and extending downward from a lower surface of the third foot wherein the lower surface of the third foot extends from an outer edge aligned with an outer surface of the third sidewall and the fourth sidewall, the third shock absorbing element having an inner surface contacting a third corner defined by the plurality of stringers and an outer surface for contacting the another like container wherein the third shock absorbing element extends outward from the third corner defined by the plurality of stringers, and a fourth shock absorbing element connected to and extending downward from a lower surface of the fourth foot wherein the lower surface of the fourth foot extends from an outer edge aligned with an outer surface of the fourth sidewall and the first sidewall, the fourth shock absorbing element having an inner surface contacting a fourth corner defined by the plurality of stringers and an outer surface for contacting the another like container wherein the fourth shock absorbing element extends outward from the fourth corner defined by the plurality of stringers, each of the second, third and fourth shock absorbing elements configured to contact an interior portion of the like container.

14. The container of claim 13 wherein each of the first, second, third and fourth shock absorbing elements are L-shaped.

15. The container of claim 14 wherein each of the first, second, third and fourth shock absorbing elements have a rounded corner portion.

16. The container of claim 13 wherein each of the first, second, third and fourth shock absorbing elements are elastomeric.

17. The container of claim 13 wherein the first shock absorbing element includes a plurality of holes.

18. The container of claim 11 wherein the first shock absorbing element comprises a plurality of segments.

19. The container of claim 11 wherein the plurality of stringers form a rectangular shape.

* * * * *